US009843122B2

(12) United States Patent
Fuessl et al.

(10) Patent No.: US 9,843,122 B2
(45) Date of Patent: Dec. 12, 2017

(54) FIXING ELEMENT FOR CONNECTING PRINTED CIRCUIT BOARD AND BUSBAR, AND POWER DISTRIBUTOR HAVING THE SAME

(71) Applicant: Lisa Draexlmaier GmbH, Vilsbiburg (DE)

(72) Inventors: Peter Fuessl, Vilsbiburg (DE); Christian Friedrich, Landshut (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/077,811

(22) Filed: Mar. 22, 2016

(65) Prior Publication Data

US 2016/0286667 A1 Sep. 29, 2016

(30) Foreign Application Priority Data

Mar. 23, 2015 (DE) ..... 10 2015 104 297

(51) Int. Cl.

| | |
|---|---|
| ***H01R 13/436*** | (2006.01) |
| ***H01R 12/58*** | (2011.01) |
| *H01R 13/405* | (2006.01) |
| *H01R 25/16* | (2006.01) |

(52) U.S. Cl.

CPC ..... *H01R 13/436* (2013.01); *H01R 12/58* (2013.01); *H01R 13/405* (2013.01); *H01R 25/162* (2013.01); *H01R 2201/26* (2013.01)

(58) Field of Classification Search

CPC ..... H01R 4/48; H01R 9/091; H01R 9/226; H01R 11/09; H01R 12/58; H01R 13/405; H01R 13/436; H01R 25/162; H01R 43/0256; H01R 2201/26

USPC ... 439/76.1, 76.2, 78, 81, 83, 949, 786, 787, 439/796, 816–818

See application file for complete search history.

(56) References Cited

U.S. PATENT DOCUMENTS

| | | | | |
|---|---|---|---|---|
| 4,128,290 A * | 12/1978 | Mickelson | ..... | H01R 4/2491 439/391 |
| 4,842,534 A * | 6/1989 | Mobley | ..... | H01H 85/2035 337/191 |
| 5,120,232 A * | 6/1992 | Korsunsky | ..... | H01R 23/6873 439/108 |

(Continued)

FOREIGN PATENT DOCUMENTS

| | | |
|---|---|---|
| DE | 699 08 447 T2 | 4/2004 |
| EP | 2 109 186 A1 | 10/2009 |

*Primary Examiner* — Tulsidas C Patel
*Assistant Examiner* — Travis Chambers
(74) *Attorney, Agent, or Firm* — Finnegan, Henderson, Farabow, Garrett & Dunner LLP

(57) ABSTRACT

A fixing element may include a pin connecting surface configured to conductively contact a pin of a busbar, and a detent configured to latch with the pin. The detent may be disposed above the pin connecting surface and bent in a first direction perpendicular to a longitudinal axis of the fixing element. The fixing element may also include a tab separated from the detent along the longitudinal axis of the fixing element, and a board connecting surface joined to the tab. The board connecting surface may be bent in a second direction perpendicular to the longitudinal axis of the fixing element. The second direction may be opposite to the first direction.

20 Claims, 7 Drawing Sheets

(56) References Cited

U.S. PATENT DOCUMENTS

| | | | | |
|---|---|---|---|---|
| 5,383,800 | A * | 1/1995 | Saka | B60R 16/02 439/76.2 |
| 6,015,302 | A * | 1/2000 | Butts | B60R 16/0238 439/76.2 |
| 6,116,916 | A | 9/2000 | Kasai | |
| 6,280,253 | B1 * | 8/2001 | Kraus | H01R 9/2458 439/594 |
| 7,075,488 | B2 * | 7/2006 | Kawahara | H01Q 1/1207 343/702 |
| 7,137,829 | B2 * | 11/2006 | Onizuka | H05K 7/20854 439/76.2 |
| 7,215,555 | B2 * | 5/2007 | Takagi | H05K 1/029 361/600 |
| 8,027,168 | B2 * | 9/2011 | Senk | B60R 16/0238 174/387 |
| 9,379,493 | B2 * | 6/2016 | Aizawa | H01R 13/6588 |
| 2005/0282414 | A1 * | 12/2005 | Eakins | H01R 13/113 439/78 |
| 2006/0040527 | A1 * | 2/2006 | Shirota | H01R 9/2466 439/76.2 |
| 2013/0095696 | A1 * | 4/2013 | Matsumura | H01H 85/044 439/620.26 |

* cited by examiner

FIXING ELEMENT FOR CONNECTING PRINTED CIRCUIT BOARD AND BUSBAR, AND POWER DISTRIBUTOR HAVING THE SAME

CROSS REFERENCE TO RELATED APPLICATION

This application is based upon and claims the benefit of prior German Patent Application No. 10 2015 104 297.5, filed on Mar. 23, 2015, the entire contents of which are incorporated herein by reference.

TECHNICAL FIELD

Embodiments of the present disclosure relate to a fixing element for electrically and mechanically connecting a printed circuit board to at least one pin of a busbar, to a busbar, and to a power distributor of a vehicle equipped therewith.

BACKGROUND

Power distributors may be used in vehicle technology, in particular in motor vehicle technology, as a kind of node for the electrical onboard power system of the vehicle. Such a power distributor of a vehicle may comprise multiple terminals for the electrically conductive connection to consumers of the vehicle and/or to one or more wiring harnesses. Such a power distributor moreover may comprise various electrical and/or electronic components, such as protective devices, relays or switching elements, to control certain vehicle functions, to switch the same, or the like. These electrical and/or electronic components may be disposed on a printed circuit board populated in advance as needed.

Depending on the design, such a power distributor of a vehicle can comprise one or more busbars, which may be produced from a metal material having comparatively good electrical conductivity and good thermal conductivity, for example. The respective busbar may include one or more pins, which may also be designed in one piece with the respective busbar using a machining or cutting manufacturing method.

Such a power distributor furthermore may include a housing into which the respective busbar, together with the pins, is inserted or insert injection-molded. In this way, the pins are may be optionally disposed in a stationary manner in the housing. The housing may be produced from a plastic material, which may allow the power distributor to be disposed outside a vehicle interior, for example in the vicinity of an engine compartment of a vehicle.

To assemble or subassemble the power distributor, the previously populated printed circuit board can be mounted onto the one or more pins disposed in the housing. For an electrically conductive and/or thermally conductive connection of the printed circuit board to the one or more pins, these may be soldered to the printed circuit board when the printed circuit board is installed, which thereby mounts the printed circuit board. Due to the soldering temperature that is required for this purpose, heat may be introduced into the housing of the power distributor when the pins are soldered to the printed circuit board. This heat input may be controlled by way of the number of intended soldering areas and/or the soldering duration or soldering intervals only to a limited extent. It may therefore be necessary to select or design the plastic material of the housing of the power distribution such that the same has a sufficiently high melting temperature so as not to be damaged when the pins are soldered to the printed circuit board.

While from a functional perspective such a power distributor can be used comparatively well in vehicle technology, the material selection and/or the assembly or manufacturing process may be comparatively complex. With respect to the material costs and/or manufacturing costs, a desire therefore may exist for a more cost-effective design of a power distributor.

SUMMARY

Embodiments of the present disclosure may provide an improved option for connecting a printed circuit board, which may allow for an inexpensive connection of a printed circuit board to a pin in terms of the material and from a manufacturing point of view. Embodiments of the present disclosure may also create a busbar and a power distributor having such features.

Embodiments of the present disclosure include a fixing element to electrically and mechanically connect a printed circuit board to at least one pin. For the connection to the at least one pin, the printed circuit board may be mounted onto the at least one pin when the printed circuit board is installed. According to the embodiments of the present disclosure, the fixing element may be designed or configured such that it can be locked on the at least one pin, thereby connecting the printed circuit board.

The printed circuit board may therefore not be joined or connected to the at least one pin by way of an integral connection, such as a soldered connection, for example, but may still be electrically and/or mechanically connected thereto in a non-integral manner. This means that the printed circuit board may not be necessarily directly fastened to the pin, but may be connected thereto or held thereon by way of the fixing element as an intermediate element. The fixing element may also function as an electrically conductive and/or thermally conductive connecting element.

The fixing element according to embodiments of the present disclosure therefore may provide that no heat from soldering occurs during the assembly and a conductive, solder-free connection of the printed circuit board to the at least one pin is provided. As a result, melting or damage to the housing of the power distributor caused thereby may be avoided. A material of a housing receiving the pin, and optionally the printed circuit board, can therefore have a comparatively low melting point, whereby the material costs for producing the printed circuit board connecting structure and/or of a power distributor equipped therewith may be reduced. Moreover, this may lower or eliminate the risk that populating elements of the printed circuit board can be desoldered or detached (fully or partially) by heat input caused by the soldering process, and may therefore qualitatively improve the entire manufacturing process for a power distributor of a vehicle with respect to reliability and/or scrap. The form-locked connection can also be detached again, whereby the printed circuit board can be individually replaced in the event of a fault. Thus, the maintenance costs of the power distributor equipped therewith may be reduced.

Embodiments of the present disclosure may provide that the fixing element is configured, for example with respect to the geometry or shape thereof, in such a way that it can be mounted onto the at least one pin when the printed circuit board is installed. This can take place from above in the mounting direction, for example. The fixing element can be located above the printed circuit board after being mounted, so that the printed circuit board is secured by the fixing element against a movement in a direction opposite the mounting direction.

In this way, soldering for a conductive connection of the printed circuit board to the at least one pin may be replaced with a mounting/attachment process that can be integrated into the assembly process. This may allow the manufacturing or assembly costs to be lowered because time expenditure for the mounting/attachment is low and no soldering station or soldering robot, including the corresponding work environment, may be needed.

It may be provided that initially the printed circuit board to be connected and/or to be fixed or to be fastened is mounted onto the at least one, or optionally multiple, stationary pins so that the pin extends, or the pins extend, through the printed circuit board. The mountable fixing element may then be mounted onto the pin or pins protruding beyond the printed circuit board. It may be provided that the printed circuit board is seated in a planar manner on an insert-molding or the like of a busbar.

Optionally, without an additional tool, embodiments of the present disclosure may provide that the fixing element comprises at least one detent element, which can be brought into a latching engagement with the pin. For example, the detent element can be designed as a kind of detent tongue, which can have an spring-loaded design (for example an elastic design), for example, or alternatively can also be configured such that it is bent into the latching engagement thereof with the pin after the fixing element has been mounted onto the at least one pin.

So as to lock the fixing element to the at least one pin securely, reliably and with a simple design in a form-locked manner, embodiments of the present disclosure may provide that the at least one pin can have an engagement groove with which the fixing element can be brought into latching engagement. This engagement groove can be designed, for example, as a kind of depression or recess on a flat, lateral surface of the pin. So as to make the manufacturing process for this purpose easier, an engagement groove may be only provided on a single side or lateral surface of the pin. However, respective engagement grooves may also be formed on multiple sides, for example on two mutually opposing sides. A peripheral engagement groove may be formed on the pin. The one or more engagement grooves can each be formed as part of the shaping process of the pin (such as a primary shaping process), or alternatively they can be formed subsequent thereto using a machining manufacturing process.

So as to also function as a conductive transmission element, in addition to the mechanical fixation of the printed circuit board, the fixing element itself can be designed to be conductive. For this purpose, for example, the fixing element can be produced from an electrically conductive and in addition may also be produced from a thermally conductive material, such as a suitable metal, for example copper, a copper alloy, steel, aluminum, a copper, steel and/or aluminum alloy, or the like.

For an electrically conductive and thermally conductive connection of the printed circuit board to the at least one pin, the fixing element can comprise at least one pin connecting surface, which can be brought into conductive contact with the at least one pin. For example, this pin connecting surface can be disposed on the fixing element such that it faces a correspondingly designed contact surface of the pin when the fixing element is mounted and/or installed. Moreover, the pin connecting surface can be in electrically conductive and/or thermally conductive contact with the pin, such as with a contact surface of the same, when the fixing element is installed. When the at least one pin comprises an encapsulation, for example in the form of an insert-molding made of plastic material or the like, the contact surface of the pin can be formed, for example, by a recess of the encapsulation or insert-molding.

Embodiments of the present disclosure may provide that the fixing element comprises at least one printed circuit board connecting surface, which can be brought into conductive contact with the printed circuit board. The conductive contact with the printed circuit board may be planar contact. The printed circuit board connecting surface can be configured or disposed in such a way that it faces a surface or contact surface of the printed circuit board, for example, when the fixing element is mounted to and/or installed in the printed circuit board. This surface can be disposed on an upper face of the printed circuit board when the printed circuit board is installed. The printed circuit board connecting surface can be designed to be electrically conductive and/or thermally conductive. In this way, heat dissipation of the printed circuit board as a function of the temperature distribution within the printed circuit board connecting structure or within a vehicle power distributor equipped therewith, for example, can be achieved in that the printed circuit board connecting surface may form a portion of a heat transmission path. The fixing element therefore may provide fixing of the printed circuit board, and an electrically conducting and thermally conducting connection between the printed circuit board and the at least one pin, and optionally elements disposed downstream thereof, such as a heat sink.

For a substantially resistance-free conduction of electrical current and/or heat, the pin connecting surface and the printed circuit board connecting surface can be disposed on the same (for example, a shared) side of the at least one pin when the fixing element and/or the printed circuit board fixed therewith are installed. Thus, the shortest possible path can be implemented. This means that the pin connecting surface and the printed circuit board connecting surface, as seen from the pin, can be disposed in a direction that is perpendicular to the mounting direction of the printed circuit board or of the fixing element.

To secure or fix the printed circuit board against a movement in a direction against the mounting direction, and also to achieve a shape of the fixing element that covers as large a surface as possible and is simple in terms of the geometry, the printed circuit board connecting surface can be configured such that it is seated at least partially on the printed circuit board or the surface thereof when installed. The printed circuit board connecting surface can be designed in the manner of a tab of the fixing element, for example. The printed circuit board connecting surface can be disposed on a lower face of the fixing element in the mounting direction of the same. For example, the printed circuit board connecting surface can be at least partially seated on an upper face of the printed circuit board when installed. Moreover, the printed circuit board connecting surface can be in contact with a correspondingly designed contact surface of the printed circuit board when installed so as to conduct electrical current and/or heat to the printed circuit board or away from the same.

If more than a single pin is provided, the fixing element can have a substantially meander-shaped design for a plurality of pins. This means, among other things, that the pin connecting surface and the printed circuit board connecting surface are located on two opposing sides of the pins in the case of two pins disposed adjoining each other. Such a geometrically implemented shape of the fixing element may allow efficient conduction of electrical current and/or heat and simultaneously comparatively low material use to be achieved.

The fixing element may be cost-effective and easily implementable from a manufacturing point of view if the fixing element is a separate stamped/bent part. The material used can be a stampable and/or bendable metal, for example copper, a copper sheet, a copper alloy, steel, a steel sheet, aluminum, an aluminum alloy, an aluminum sheet or the like. The material may have a comparatively high electrical conductivity and/or high thermal conductivity.

Embodiments of the present disclosure also relate to a busbar comprising at least one pin, which may have an engagement groove on which a fixing element can be locked in a form-locked manner in one or more of the above-described embodiments.

Embodiments of the present disclosure may provide that the at least one pin is directly or indirectly connected to at least a single busbar or multiple busbars. The pin or the pins can be designed in one piece with the busbar or busbars. The busbars themselves can be produced from oxygen-containing (such as tough pitch) copper produced by electrolytic refining or another suitable material. Moreover, the at least one busbar can comprise an insert-molding, such as an insert-molding with a high heat resistant plastic material, which can also have comparatively high thermal conductivity. The at least one busbar can comprise one or more heat sinks. The heat sink or heat sinks can be integrated into the insert-molding. By connecting the printed circuit board to the at least one pin by way of the fixing element, a heat transmission path can be created, which leads from the printed circuit board via the printed circuit board connecting surface, such as the pin connecting surface, and the at least one pin to the at least one heat sink of the busbar. In this way, heat dissipation of the elements disposed in the heat transmission path may be provided.

Embodiments of the present disclosure also relate to a power distributor of a vehicle, for example of a motor vehicle, comprising at least one busbar having at least one pin, a housing, and a fixing element according to one or more of the above embodiments for mechanically and electrically (conductively) connecting a printed circuit board to the at least one busbar.

Such a vehicle power distributor may provide that no heat input from soldering occurs during the assembly, and that a conductive, non-integral connection of the printed circuit board to the at least one pin is provided. For this reason, a material, for example a plastic material, of a housing receiving the pin, and optionally the printed circuit board, can have a comparatively low melting point, whereby the material costs for producing the connection of the printed circuit board and/or for producing a power distributor equipped therewith may be low. Moreover, this may lower or eliminate the risk that populating elements of the printed circuit board can be desoldered by a heat input caused by soldering. Thus the entire manufacturing process for a power distributor may be improved.

Further features of the present disclosure are disclosed in the detailed description, the accompanying figures, and in the attached claims.

BRIEF DESCRIPTION OF THE FIGURES

The figures are only schematic representations and are provided only to explain embodiments of the present disclosure. Like elements are uniformly denoted by like reference numerals.

DETAILED DESCRIPTION

Figure 1:
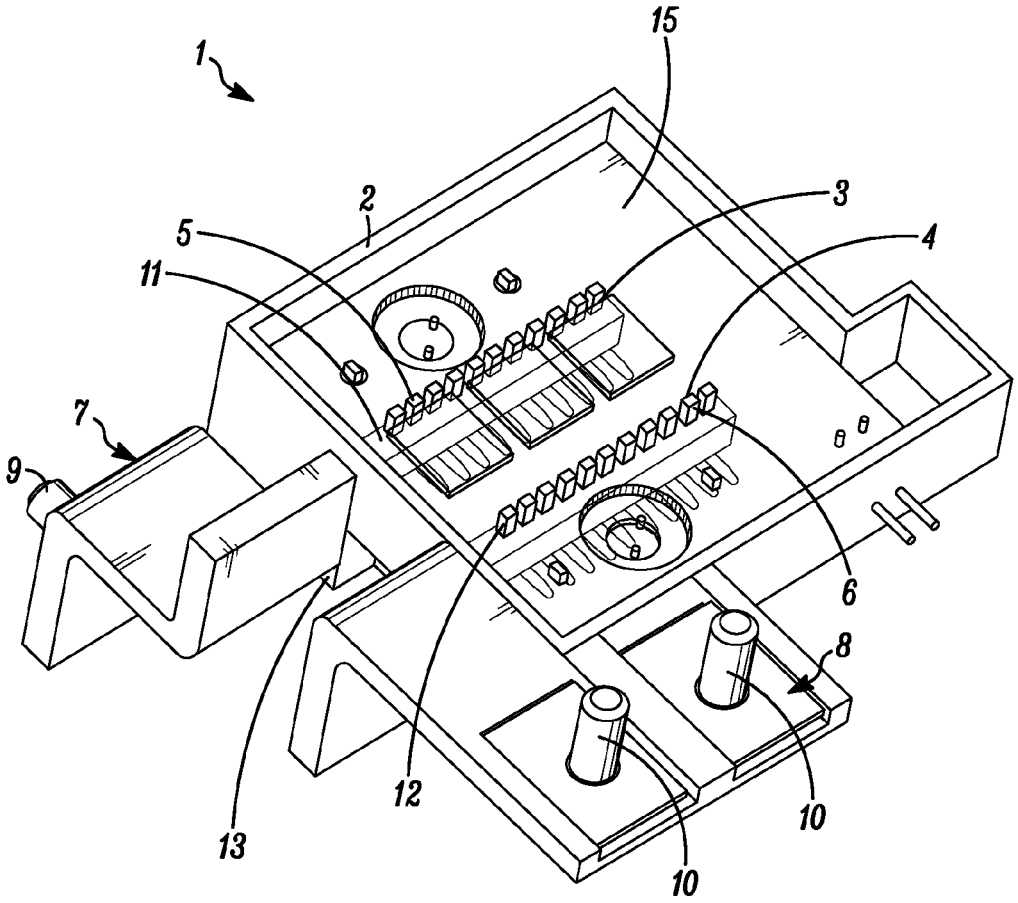
FIG. 1 shows a portion of a power distributor in a perspective top view.

FIG. 1 shows a perspective top view onto a portion of a power distributor 1 of a vehicle (not shown here), which serves as a kind of node of an electrical onboard power system of the vehicle equipped therewith.

The power distributor comprises a housing 2, of which only a lower portion is illustrated. The housing 2 may be produced from plastic material, which may have a comparatively low melting point but is, for example, suitable for being disposed in the vicinity of an engine compartment of the vehicle. The housing 2 can be closed by way of an upper part (not shown here) or cover.

A first busbar 3 and a second busbar 4 may be accommodated and securely fastened in the lower part of the housing 2. The first and the second busbars 3 and 4 may be produced from a copper alloy, such as electrolytic-tough-pitch copper (Cu-ETP). The first busbar 3 and the second busbar 4 each may have an angled design and are insert injection-molded into the housing 2.

Each of the busbars 3 and 4 may have a plurality of pins 5 and 6 at a first end, which are disposed in a stationary manner in the housing 2 as a result of the secure fastening of the busbars 3 and 4. Each of the plurality of pins 5 and 6 can be designed in one piece with the respective busbar 3 and 4. A second end 7, 8 of each of the busbars 3 and 4, which is opposite the first end, can be coupled to at least one electrical terminal piece 9, 10, by way of which an electrical connection of the power distributor 1 to consumers or a wiring harness of the vehicle can be established. In FIG. 1 each of the electrical terminal pieces 9 and 10 has a pin-shaped design.

In FIG. 1 beneath the respective pins 5 and 6, each of the busbars 3 and 4 comprises an insert-molding 11, 12, which can be made of a comparatively heat resistant plastic material. The respective insert-moldings 11 and 12 can be disposed such that the upper ends of the pins 5 and 6 in FIG. 1 in each case protrude upward in FIG. 1 beyond the insert-moldings 11 and 12, i.e., the upper ends of the pins 5 and 6 are exposed. Each of the insert-moldings 11 and 12 may include an integrated heat sink having cooling fins preferably formed thereon to dissipate heat from the first busbar 3 and the second busbar 4. In FIG. 1, the integrated heat sink 13 of the insert-molding 11 is shown. The integrated heat sink of the insert-molding 12 is blocked and cannot be seen in FIG. 1.

In FIG. 1, the power distributor 1 furthermore may include a printed circuit board 15, which is mounted onto the respective plurality of pins 5 and 6 of the first busbar 3 and of the second busbar 4, wherein the pins each extend through correspondingly disposed through-holes of the printed circuit board 15. The printed circuit board 15 may be substantially seated on the insert-moldings 11 and 12. Furthermore, the printed circuit board 15 can be populated with a plurality of electrical and/or electronic components that can be configured as needed.

Figure 2:
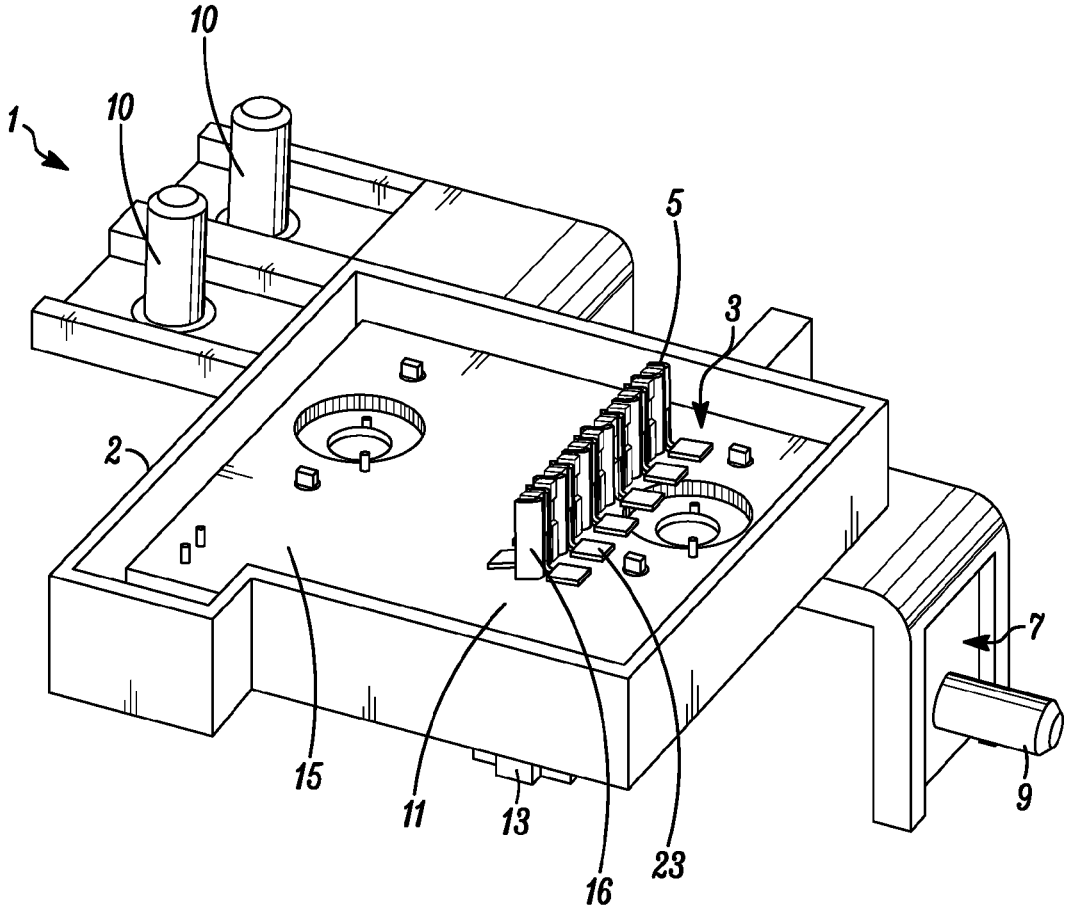
FIG. 2 shows a portion of the power distributor comprising a fixing element according to the present disclosure in a perspective side view.

In FIG. 2, which shows a portion of the power distributor 1 in a perspective side view, the second busbar 4 is hidden for better illustration.

The printed circuit board 15 is electrically conductively and/or thermally conductively connected to the plurality of pins 5 by way of a fixing element 16. The fixing element 16, which may be designed to be separate for this purpose, for the conductive connection of the printed circuit board 15 to the pins 5 is mounted onto the pins 5 from above in FIG. 2. The printed circuit board 15 can also be electrically conductively and/or thermally conductively connected to the plurality of pins 6 of the second busbar 4 (hidden here) by way of the fixing element 16 or a further such fixing element in the same or similar manner. In this way, the pins 5 or 6, the printed circuit board 15 mounted thereon, and the fixing element 16 mounted onto the pins 5 or 6 can form a printed circuit board connecting structure for the power distributor 1.

Figure 3:
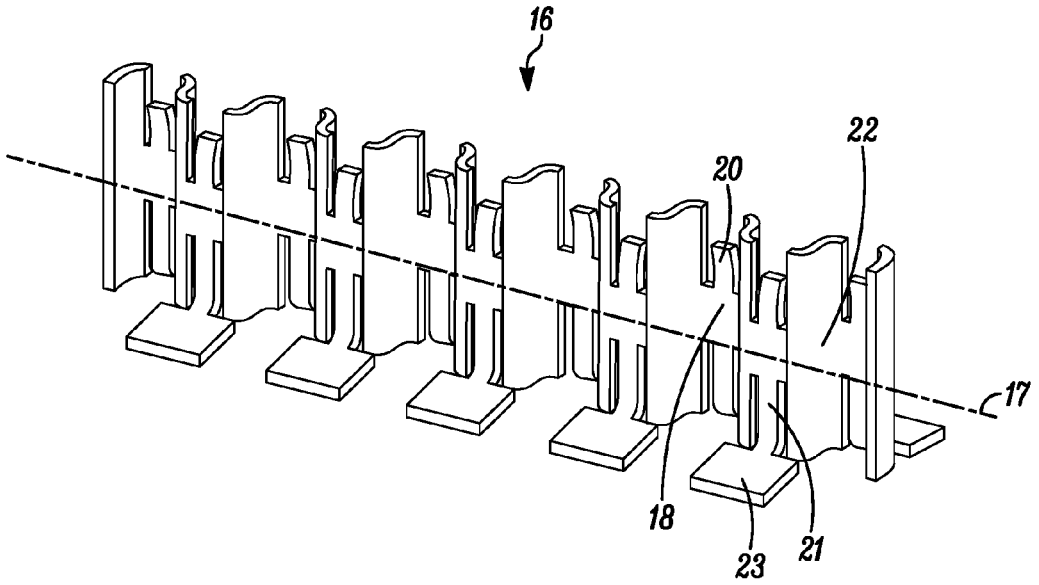
FIG. 3 shows the fixing element according to the present disclosure represented on its own in a perspective side view.

FIG. 3 shows the individually represented fixing element 16 in a perspective side view. The fixing element 16 may be designed as a stamped/bent part made of a suitable material, such as a metallic material, for example as copper, steel, aluminum, an alloy or the like. Along the longitudinal axis 17, the fixing element 16 may comprise a plurality of pin connecting surfaces 18, which are in conductive contact with a respective correspondingly designed pin contact surface 19 of the pins 5 (see FIG. 4) when the fixing element 16 is installed or mounted.

Moreover, the fixing element 16 can comprise a plurality of detent elements 20 along the longitudinal axis 17, which in FIG. 3 are each disposed above the respective pin connecting surface 18. In this embodiment, the respective detent element 20 can be designed as a kind of tongue or detent tongue, which is bent in a direction that is perpendicular to the longitudinal axis 17 and extends toward the respective pin 5 when the fixing element 16 is installed.

The fixing element 16 furthermore can comprise a plurality of tabs 21 along the longitudinal axis 17, which are each separated from a respective detent element 20 by a land 22. Each tab 21 of the fixing element 16 may join a printed circuit board connecting surface 23, which is bent in a direction that is perpendicular to the longitudinal axis 17 and opposite the bending direction of the respective detent element 20. This means that the respective detent element 20 and the pin connecting surface 18 disposed in vicinity thereto may be each located on a side of the fixing element 16 that is opposite the respective printed circuit board connecting surface 23. The detent elements 20 or the pin connecting surfaces 18 and the printed circuit board connecting surfaces 23 can be disposed in an alternating manner along the longitudinal axis 17 of the fixing element 16. In this way, the fixing element 16 may have a substantially meander-shaped design.

Figure 4:
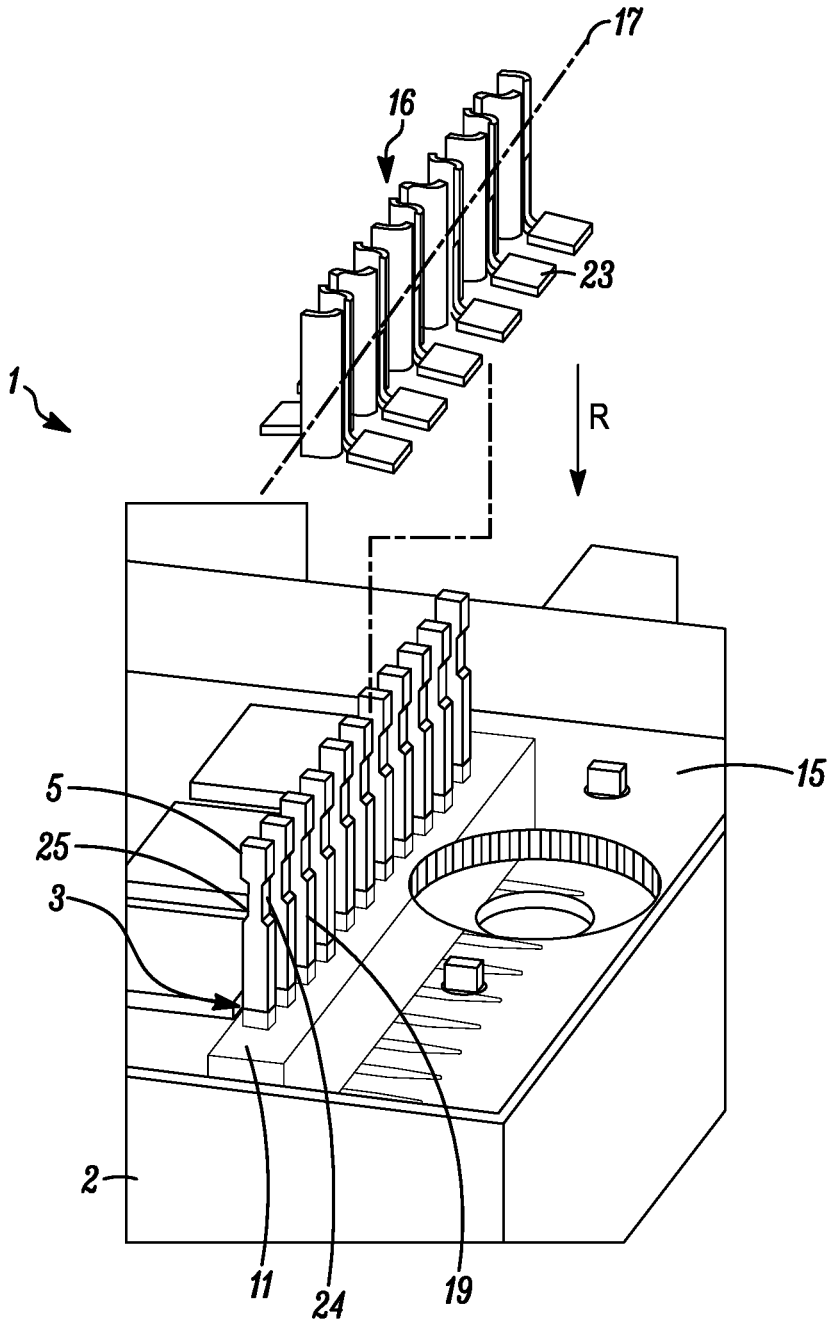
FIG. 4 shows a partial section of the power distributor comprising a plurality of pins on a busbar, a printed circuit board mounted thereon, and the fixing element mountable onto the pins.

FIG. 4, which shows a partial section of the power distributor 1 having a printed circuit board 15 mounted onto the pins 5 in a perspective side view, illustrates a mounting direction R of the fixing element 16 (which is not mounted here). This mounting direction R may be substantially perpendicular to the longitudinal axis 17 of the fixing element 16. The plurality of pins 5 of the first busbar 3 may have a substantially cuboid design and each may have a first engagement groove 24 and a second engagement groove 25 disposed opposite the same. In this embodiment, due to the alternating arrangement of the detent elements 20, only one of the two engagement grooves 24 and 25 per pin 5 may be brought into latching engagement with the respective detent element 20.

Figure 5:
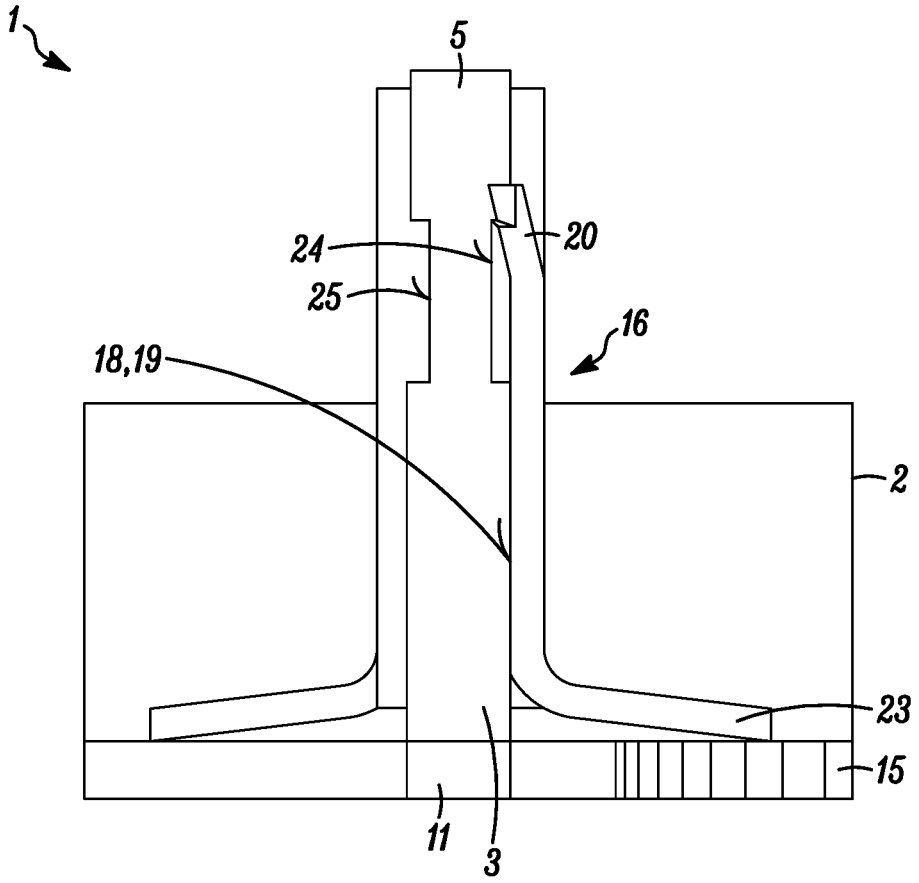
FIG. 5 shows a side view of a pin and of the fixing element mounted thereon, which can be brought into latching engagement with an engagement groove.

FIG. 5 shows a side view of one of the plurality of pins 5 and of the fixing element 16 mounted thereon. The respective detent element 20 of the fixing element 16 can be brought or is brought into latching engagement with the respective engagement groove 24 or 25 of the plurality of pins 5. An electrically conductive and/or thermally conductive contact having a comparatively large surface area may be present between the respective pin connecting surface 18 of the fixing element 16 and the respective pin contact surface 19 of the pins 5. The respective printed circuit board connecting surface 23 of the fixing element 16 may be at least partially seated on an upper face of the printed circuit board 15 when the fixing element 16 is installed. For an electrically conductive and/or thermally conductive connection, the printed circuit board 15 can have a correspondingly designed, conductive contact area (not shown here) at least in the region of the respective printed circuit board connecting surface 23 of the fixing element 16.

Figure 6:
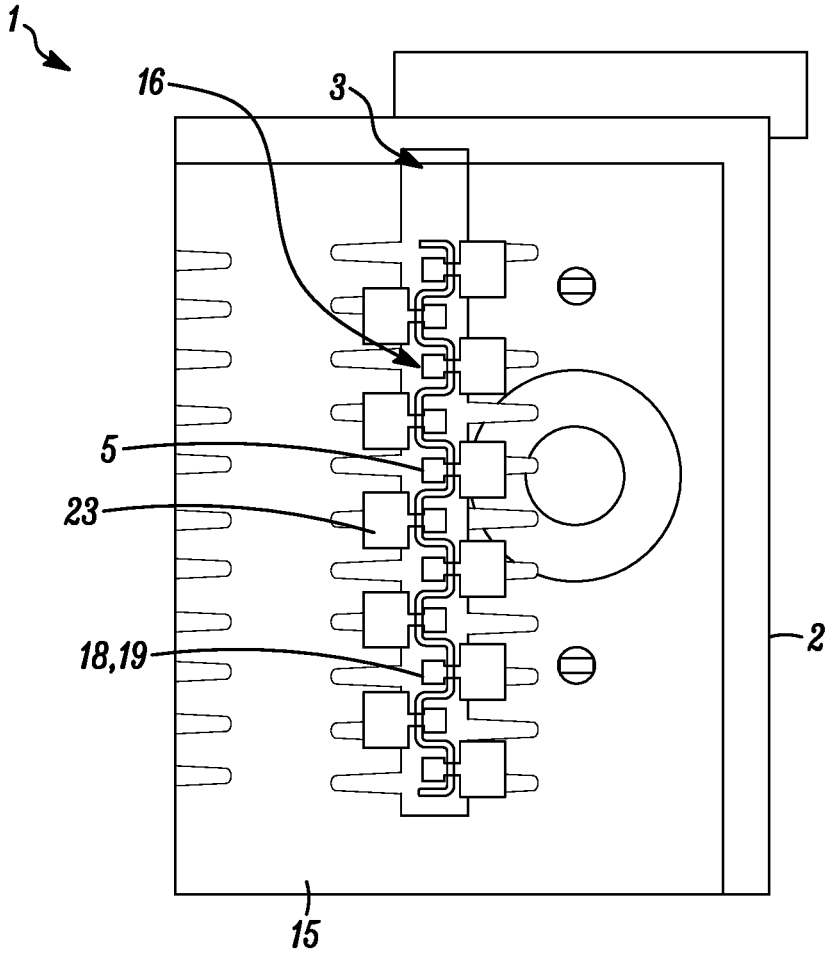
FIG. 6 shows a partial section of a power distributor comprising the plurality of pins on the busbar, the printed circuit board mounted thereon, and the fixing element that is mounted onto the pins and locked thereon.

In FIG. 6, which shows a partial section of a power distributor 1 in a top view, the fixing element 16 is illustrated in the mounted installation state. The detent elements 20 or the pin connecting surfaces 18 and the printed circuit board connecting surfaces 23 may be alternately disposed along the longitudinal axis 17 of the fixing element 16, whereby the fixing element 16 may have a substantially meander-shaped design.

Based on FIG. 7, which shows a section through a partial section of the power distributor 1 comprising the first busbar 3, one of the plurality of pins 5 and the insert-molding 11 thereof with the heat sink 13, the printed circuit board 15 mounted thereon, and the mounted fixing element 16, the principle of electrical conduction and thermal conduction shall now be described.

Figure 7:
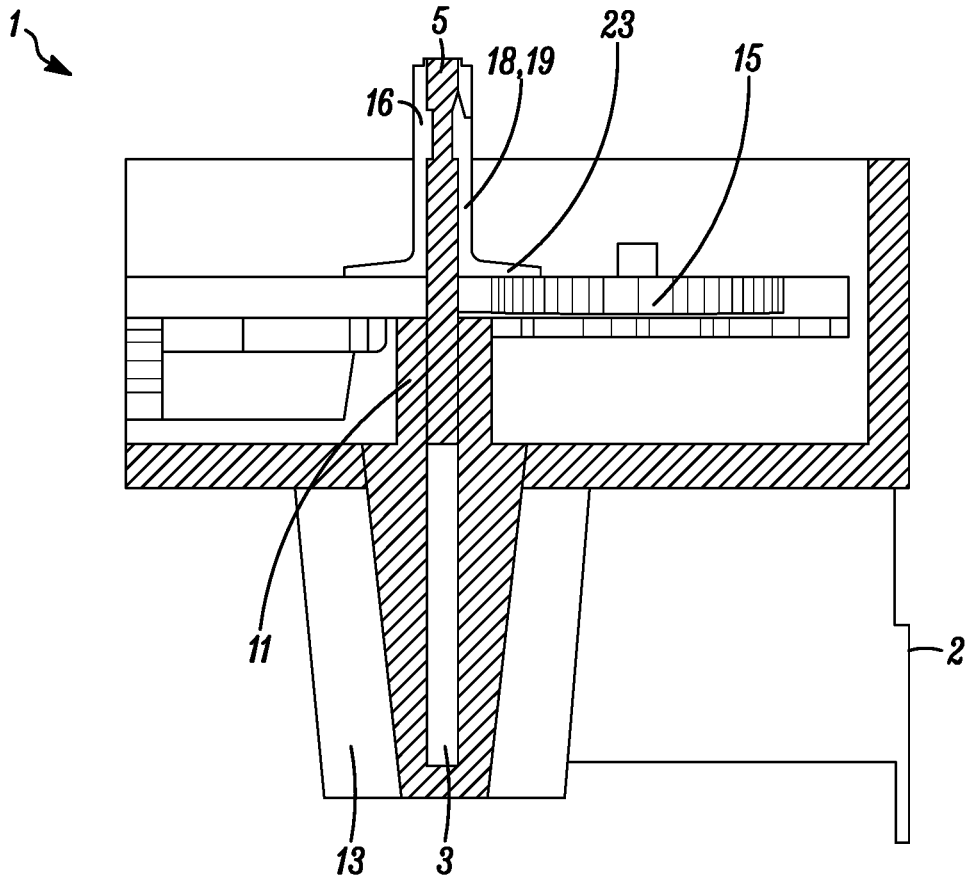
FIG. 7 shows a sectional view through a partial section of the power distributor comprising an insert-molded busbar, which comprises a pin and a heat sink, the mounted printed circuit board, and the fixing element for connecting the printed circuit board to the pin in a form-locked manner.

As shown in FIG. 7 and described above, the respective pin connecting surface 18 of the fixing element 16 and the respective pin contact surface 19 of the pins 5 or 6 may be in conductive contact with each other when installed, i.e., when mounted and engaged.

The conduction of electrical current between the printed circuit board 15 or a surface thereof and the respective busbar 3 or 4 may take place via the respective printed circuit board connecting surface 23 of the fixing element 16 seated on the printed circuit board 15, the pin connecting surface 18 of the fixing element 16, and the respective pin contact surface 19 of the pins 5 or 6 in contact therewith. With respect to the heat conduction, heat convection may develop when the printed circuit board 15 is heated in relation to the respective heat sink, such as the heat sink 13. This heat convection may lead from the printed circuit board 15 via the respective printed circuit board connecting surface 23 of the fixing element 16 seated thereon, the pin connecting surface 18 of the fixing element 16, and the respective pin contact surface 19 of the pins 5 or 6 in contact therewith, via the respective insert-molding 11 or 12, to the respective heat sink, such as the heat sink 13, designed integrally therewith. The heat can be dissipated across a large surface area via the heat sinks, such as the heat sink 13, whereby heat can be dissipated from the power distributor 1.

The assembly of the power distributor 1 can take place as described hereafter based on FIG. 4, which shows a partial section of the power distributor 1 having a printed circuit board 15 mounted onto the pins 5 in a perspective side view.

Initially, the housing 2 including the insert injection-molded respective busbar 3 or 4 may be provided as a preform. The printed circuit board 15 may be mounted onto the respective plurality of pins 5 and 6 in such a way that the printed circuit board 15 is seated on the respective insert-molding 11 or 12. The stationary pins 5 or 6 may extend through the printed circuit board 15. The fixing element 16 designed separately from the pins 5 and 6 and from the printed circuit board 15 may be mounted from above in the mounting direction R onto the pins 5 or 6 protruding over the printed circuit board 15. The respective detent element 20 of the fixing element 16 may be brought into latching engagement with the respective engagement groove 24 or 25 of the pins 5 or 6.

The fixing element 16 according to embodiments of the present disclosure and the power distributor 1 embodiments of the present disclosure can be modified in a variety of ways.

For example, only a single, lateral engagement groove 24 or 25 may be provided for the plurality of pins 5 or 6. The pins 5 or 6 may have a single peripheral engagement groove. Moreover, the printed circuit board connecting surfaces 23 of the fixing element 16 and the pin connecting surfaces 18 of the fixing element 16 do not have to be disposed in an alternating manner, and can also be disposed in a differently distributed manner.

What is claimed is:

1. A fixing element comprising:

a pin connecting surface configured to conductively contact a pin of a busbar;

a detent configured to latch with the pin, wherein the detent is disposed above the pin connecting surface and bent in a first direction perpendicular to a longitudinal axis of the fixing element;

a tab separated from the detent along the longitudinal axis of the fixing element; and a board connecting surface joined to the tab, wherein the board connecting surface is bent in a second direction perpendicular to the longitudinal axis of the fixing element, and the second direction is opposite to the first direction.

2. The fixing element according to claim 1, wherein the detent is configured to latch with an engagement groove of the pin.

3. The fixing element according to claim 1, wherein the fixing element is made of a conductive material.

4. The fixing element according to claim 1, wherein the pin connecting surface and the board connecting surface are configured to be disposed on a same side of the pin.

5. The fixing element according to claim 1, wherein the fixing element includes a stamped or bent part.

6. The fixing element according to claim 1, wherein the fixing element comprises a plurality of pin connecting surfaces.

7. The fixing element according to claim 6, wherein the fixing element comprises a plurality of board connecting surfaces configured to conductively contact a printed circuit board.

8. The fixing element according to claim 7, wherein the plurality of pin connecting surfaces and the plurality of board connecting surfaces are configured in an alternating pattern along the longitudinal axis of the fixing element.

9. A power distributor comprising:

a housing;

a busbar fastened to the housing and including:

an insert-molding made from a heat-resistant plastic; and a pin disposed on the insert-molding and including an engagement groove on a lateral surface of the pin;

a printed circuit board mounted onto the pin, wherein the pin extends through a through hole of the printed circuit board; and a fixing element conductively connecting the printed circuit board to the pin in a form-locked manner.

10. The power distributor according to claim 9, wherein the fixing element includes:

a pin connecting surface configured to conductively contact the pin of the busbar;

a detent configured to latch with the pin, wherein the detent is disposed above the pin connecting surface and bent in a first direction perpendicular to a longitudinal axis of the fixing element;

a tab separated from the detent along the longitudinal axis of the fixing element; and a board connecting surface joined to the tab, wherein the board connecting surface is bent in a second direction perpendicular to the longitudinal axis of the fixing element, and the second direction is opposite to the first direction.

11. The power distributor according to claim 10, wherein the board connecting surface is configured to at least partially seat on the printed circuit board.

12. The power distributor according to claim 10, wherein the detent of the fixing element is in a latching engagement with the engagement groove of the pin.

13. The power distributor according to claim 9, wherein the fixing element is made of a conductive material.

14. The power distributor according to claim 9, wherein the fixing element includes a stamped or bent part.

15. The power distributor according to claim 9, wherein the insert-molding of the busbar is configured such that an upper end of the pin is exposed and protrudes upward.

16. The power distributor according to claim 9, wherein the busbar comprises:

a heat sink integrated into the insert-molding, wherein the heat sink includes a cooling fin.

17. The power distributor according to claim 10, wherein the board connecting surface is configured to conductively contact the printed circuit board.

18. The power distributor according to claim 10, wherein the pin connecting surface and the board connecting surface are configured to be disposed on a same side of the pin.

19. The power distributor according to claim 10, wherein the fixing element comprises:

a plurality of pin connecting surfaces; and a plurality of board connecting surfaces configured to conductively contact the printed circuit board.

20. The power distributor according to claim 19, wherein the plurality of pin connecting surfaces and the plurality of board connecting surfaces are configured in an alternating pattern along the longitudinal axis of the fixing element.

* * * * *